US006691316B2

(12) United States Patent
Carlin

(10) Patent No.: US 6,691,316 B2
(45) **Date of Patent: *Feb. 17, 2004**

(54) MARTIAL ARTS PROTECTIVE GEAR

(75) Inventor: Mitch Carlin, Boca Raton, FL (US)

(73) Assignee: Technical Knockout, Inc., Pompano Beach, FL (US)

( * ) Notice: Subject to any disclaimer, the term of this patent is extended or adjusted under 35 U.S.C. 154(b) by 0 days.
This patent is subject to a terminal disclaimer.

(21) Appl. No.: 10/161,771

(22) Filed: Jun. 4, 2002

(65) Prior Publication Data

US 2002/0148029 A1 Oct. 17, 2002

Related U.S. Application Data

(63) Continuation of application No. 09/262,958, filed on Mar. 4, 1999, now Pat. No. 6,412,114.

(51) Int. Cl.[7] ..... A41D 13/00
(52) U.S. Cl. ..... 2/22; 128/882; 602/62
(58) Field of Search ..... 2/22, 242, 455, 2/919, 206, 64; 36/1.5, 84–85, 88, 109, 113, 140, 96, 102, 106, 114, 2 R; 602/23, 27, 28, 62, 65, 16, 1, 25, 29, 26; 128/882

(56) References Cited

U.S. PATENT DOCUMENTS

| | | | | | |
|---|---|---|---|---|---|
| 3,667,140 | A | * | 6/1972 | Hunderford | 36/4 |
| 4,624,015 | A | * | 11/1986 | Bottoms | 2/22 |
| 4,756,026 | A | * | 7/1988 | Pierce, Jr. | 2/16 |
| 4,869,267 | A | * | 9/1989 | Grim et al. | 602/27 |
| 5,211,672 | A | * | 5/1993 | Andujar | 36/106 |
| 5,987,778 | A | * | 11/1999 | Stoner | 36/1.5 |

* cited by examiner

*Primary Examiner*—Katherine Moran
(74) *Attorney, Agent, or Firm*—Malin, Haley & DiMaggio, P.A.

(57) ABSTRACT

Combination one-piece hand/forearm paddings and shin/foot paddings are disclosed, preferably, for use during martial arts events. The one-piece construction provides for a greater area of protection, and prevents the forearm and shin portions of the paddings from sliding up or down the wearer's arms and legs, respectively.

9 Claims, 4 Drawing Sheets

MARTIAL ARTS PROTECTIVE GEAR

This application is a continuation of application Ser. No. 09/262,958, now U.S. Pat. No. 6,412,114, filed on Mar. 4, 1999.

BACKGROUND OF THE INVENTION

1. Field of the Invention

The invention relates generally to the field of martial arts, and particularly, though not limiting, to protective gear worn by participants in martial arts events.

2. Description of Related Art

During martial arts competitions, practices, and sparring events, the participants often wear protective padding on certain body areas, including the hand and forearm areas and the foots and shin areas. The paddings provide protection to the wearer, as well as the wearer's opponent, when such opponent is struck by the wearer's hands or feet.

Currently, the hand and forearm pads are separate items, constructed independent of each other. Current pads typically use VELCRO® hook and loop fasteners and straps for tightening the pads on the wearer. With current paddings, several disadvantages are readily apparent. Putting on the separate pieces of padding is often difficult, and often one of the pieces is misplaced or lost. The VELCRO® hook and loop fasteners and straps are also difficult for younger users to properly manipulate. Additionally, the forearm pad is known to slide up or down the wearer's arm during use, thus, exposing areas of the wearer's arm, for which protection was initially sought.

These same disadvantages are also found with current separate foot and shin pads, with the shin pad sliding up or down the wearer's leg. Additionally, where two separate pads are provided (hand/forearm and/or foot/shin) the cost of manufacturing is also increased.

Thus, what is needed in the art is a one-piece hand/forearm pad and a one-piece foot/shin pad. It is therefore, to the effective resolution of the aforementioned problems and shortcomings that the present invention is directed.

BRIEF SUMMARY OF THE INVENTION

The present invention provides a combination one piece protective forearm and hand padding and a combination one piece protective foot and shin padding. The forearm protective portion is permanently attached to the hand/wrist protective portion preferably by stitching. Likewise, the foot/ankle portion is permanently attached to the shin portion preferably by stitching. The hand portion can include a grip bar and has finger loops attached to a outer surface for open handed wear. A "v" shaped notch is provided on the palm area of the hand portion and includes an elastic member for a comfortable, yet secure fit. The elastic member also eliminates the need for any straps and hook and loop fasteners, as is commonly found with conventional hand gloves. Additional padding can also be provided on the thumb area of the hand portion to provide additional protection to the wearer while he or she is punching an object.

The forearm and shin portions of the protective paddings incorporate elastic members for comfortable and securely positioning such portions on the wearer's arms and legs, respectively. The foot portion is provided with a toe holder for added support and also includes an extended tongue portion for additional protection.

The one-piece construction reduces the cost of the paddings and extends the protection area of the wearer.

Furthermore, the one-piece construction also prevents the forearm and shin portions from sliding or shifting up and/or down the wearer's arms and legs, respectively, as is commonly found with conventional forearm and shin pads.

Accordingly, it is an object of the present invention to provide a one-piece hand and forearm protective padding.

It is another object of the present invention to provide a one-piece shin and foot protective padding.

It is still another object of the present invention to provide a one-piece hand and forearm protective padding which does not use straps or hook and loop fasteners for attachment purposes.

It is yet another object of the present invention to provide a one-piece hand and forearm protective padding, wherein the forearm portion will not slide or shift up or down the wearer's arm during use.

It is yet still another object of the present invention to provide a one-piece shin and foot protective padding, wherein the shin portion will not slide or shift up or down the wearer's leg during use.

It is even still another object of the present invention to provide a one-piece hand and forearm protective padding which provides a greater area of protection to the wearer. It is a further object of the present invention to provide a one-piece shin and foot protective padding which provides a greater area of protection to the wearer.

It is still a further object of the present invention to provide a one-piece hand and forearm protective padding which is relatively easy to put on by the wearer, even where the wearer is a small child.

It is still yet another object of the present invention to provide a one-piece shin and foot protective padding which is relatively easy to put on by the wearer, even where the wearer is a small child.

In accordance with these and other objects which will become apparent hereinafter, the instant invention will now be described with particular reference to the accompanying drawings.

BRIEF DESCRIPTION OF THE SEVERAL VIEWS OF THE DRAWINGS

The invention may be better understood by reference to the drawings in which.

DETAILED DESCRIPTION OF THE INVENTION

Figure 1:
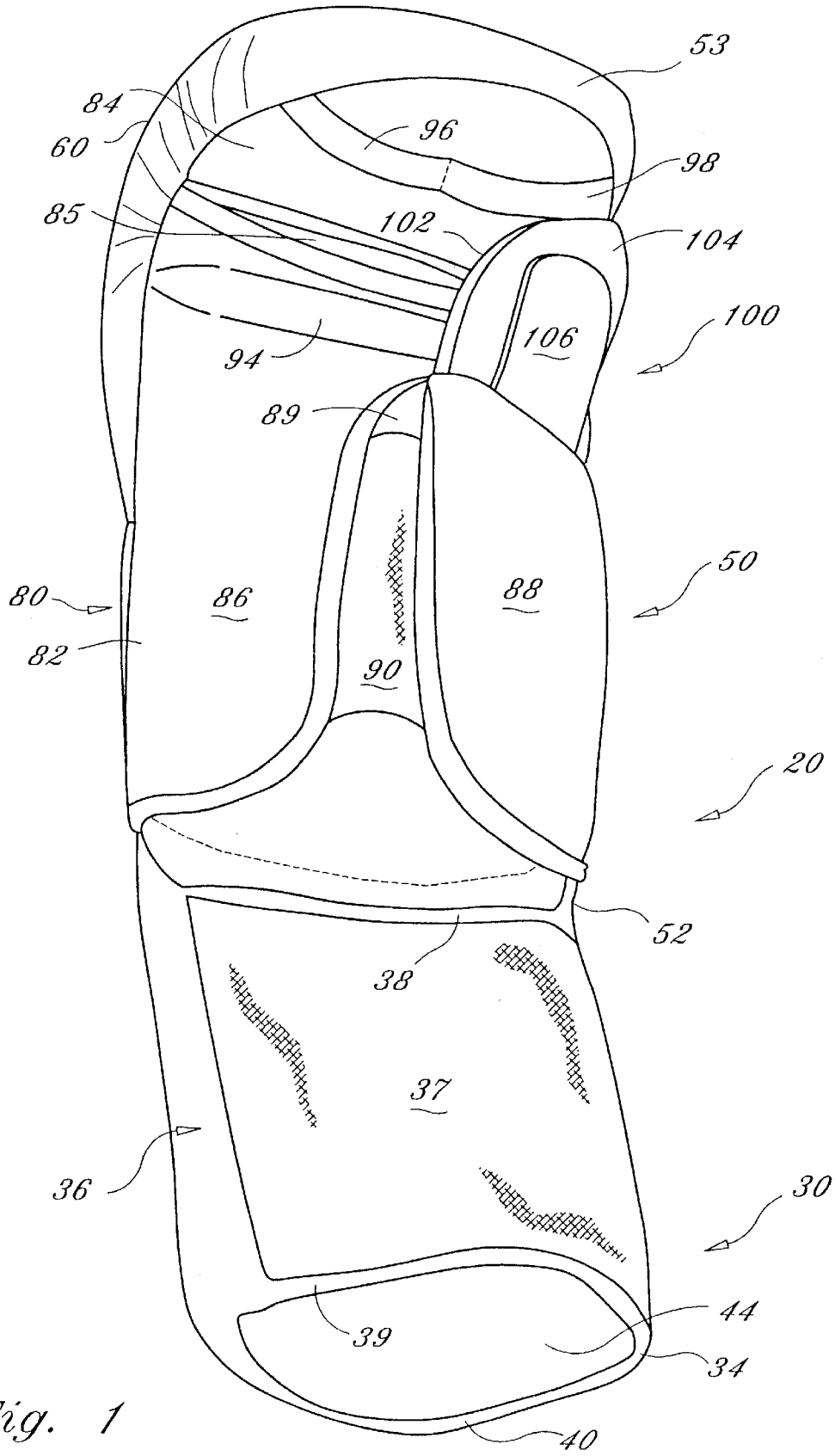
FIG. 1 is a perspective view of the protective one-piece hand and forearm padding in accordance with the present invention.
Figure 2:
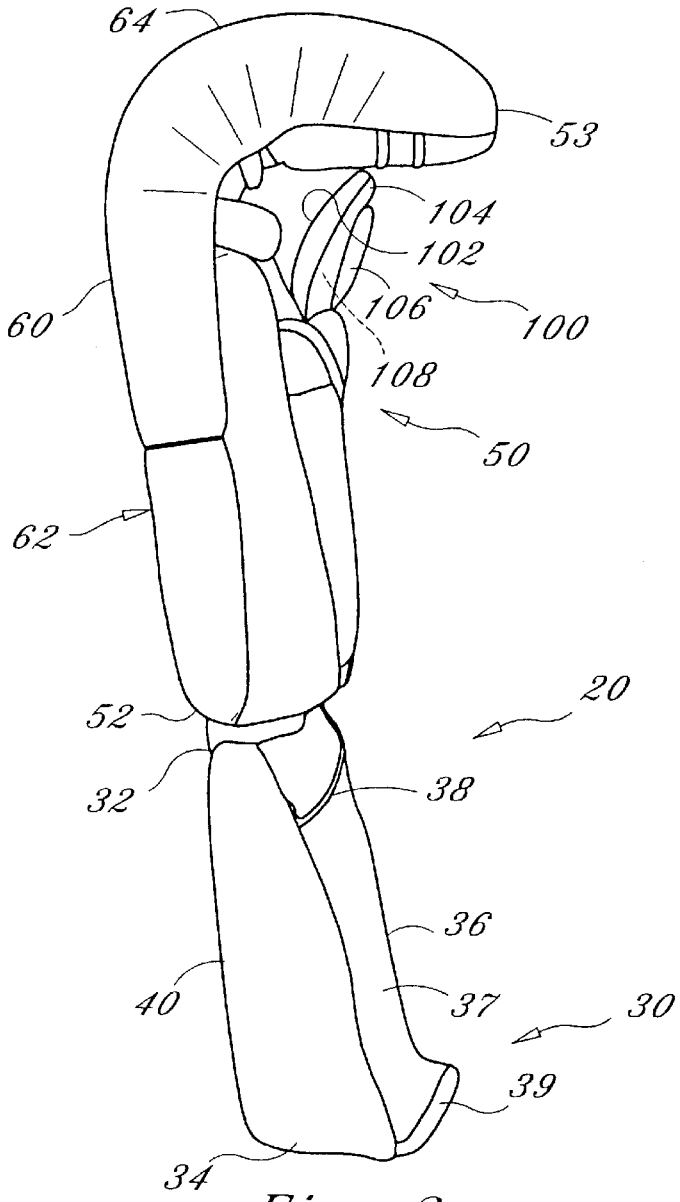
FIG. 2 is a side view of the protective one-piece hand and forearm padding of FIG. 1.

FIGS. 1 and 2 illustrate a protective one-piece hand and forearm padding, in accordance with the present invention, which is generally designated padding 20. Padding 20 generally includes a forearm protective member 30 and a hand/wrist protective member 50 which are attached to each other, preferably by double stitching, at first end 32 of member 30 and first end 52 of member 50. Though double stitching attachment is preferred, other conventional stitching and attachment arrangements can be used, and are considered within the scope of the invention. Additionally, in lieu of attaching member 30 and member 50 together, members 30 and 50 can be constructed integral.

Figure 5:
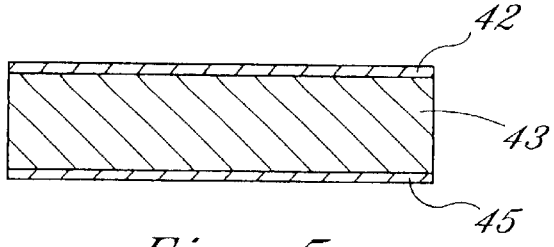
FIG. 5 is a sectional view of a portion of the forearm padding illustrating the outer material, inner padding material, and lining.

As seen best in FIG. 5, an upper portion 40 of member 30 consist of an outer material 42 which can be constructed from polyurethane, polyvinylchloride, leather, or other similar conventional materials and an inner material 43 which can be constructed from any type of conventional absorbent foam material, or other similar conventional materials. Materials 42 and 43 extend from first end 32 to a second end 34 of member 30. A lining 45, preferably waterproof and/or washable, such as a TAFETA lining, can be as provided, and serves as the inner surface of upper portion 40 which abuts at least a substantial portion of the wearer's forearm.

A lower portion 36 of member 30 consists of an elastic member 37 having less flexible ends 38 and 39. Elastic member 37 and ends 38 and 39 are attached to the sides of upper portion 40 by conventional means, such as stitching. Lower portion 36 and upper portion 40 define an opening/receiving area 44 for insertion through of the wearer's hand and wrist, and disposal of a substantial portion of the wearer's forearm when padding 20 is properly positioned. When at least a portion of the wearer's forearm is properly positioned within member 30, elastic member 37 securely, yet comfortably, wraps around the bottom portion of the wearer's arm, to firmly retain member 30 in place.

Hand/wrist member 50 consists of an upper portion 60, lower portion 80 and thumb receiving/protective section 100. Upper portion 60 includes a wrist/hand protective area 62 and a finger protective area 64. Upper portion 60 consist of an outer material, similar to material 42, which can be constructed from polyurethane, polyvinylchloride, leather, or other similar conventional materials and an inner material, similar to material 43, which can be constructed from any type of conventional absorbent foam material, or other similar conventional materials. Outer and inner materials extend from first end 52 to a second end 53 of member 50. A lining, similar to lining 45, preferably waterproof and/or washable, such as a TAFETA lining, can be as provided, and serves as the inner surface of upper portion 60 which abuts at least a substantial portion of the wearer's hand and fingers.

Lower portion 80 includes a wrist/hand area 82 and a finger area 84. Wrist/hand area 82 includes first and second non-elastic yet flexible sections 86 and 88 which are attached to upper portion 60, by conventional means such as stitching, or alternatively, can be integral with upper portion 60. Sections 86 and 88 can include an outer material similar to the outer material of upper portion 60 and can also include a lining similar to the lining of upper portion 60. Sections 86 and 88 define a substantially "v" shaped notch 89. Disposed and attached between sections 86 and 88, within notch 89 is an elastic member 90, which is attached to sections 86 and 88, by conventional means, such as stitching. Elastic member 90 provides a more comfortable fit of protective member 50 for the wearer. An opening 92 is defined between wrist/hand area 82 and upper portion 60.

The corresponding finger area of upper portion 60 and lower portion 80 are preferably preformed or curved. Similar to wrist/hand area 82 of lower portion, finger area 84 can include an outer material similar to the outer material of upper portion 60 and can also include a lining similar to the lining of upper portion 60. A slit 85 can be provided in finger area 84 to allow additional flexibility and reduce any stress on protective member 50.

A grip bar 94, preferably constructed from foam, can also be provided to provide the wearer an easier grip and help the wearer's keep his or her hand in a fist. Grip bar 94, is preferably disposed between the outer material and lining of finger area 84 and is retained in place by conventional means, such as stitching, adhesives, etc. Finger loops 96 and 98 can be attached to finger 84 by conventional means, such as by stitching, to allow the wearer to use protective member 50 for open handed wear.

Thumb protection section 100 is preferably, attached to a first end of section 86, though other conventional attachment devices can be used, or alternatively, section 100 and 86 can be constructed integral. Thumb section 100 includes an upper portion 102 having an outer material similar to the outer material of upper portion 60 and can also include a lining similar to the lining of outer portion 60. A lower portion 104 of section 100 also can include a similar outer material and lining, and is provided with additional padding 106, which can be similar in material to the inner material of upper portion 60. Padding 106 is retained in place by conventional means such as stitching, adhesives, etc. A thumb receiving area 108 is defined between upper portion 102 and lower portion 104 of thumb section 100. Thumb receiving area 108 is in communication with opening 92 defined between wrist/hand area 82 and upper portion 60.

Preferably all seams of protective one-piece hand and forearm padding 20 are double stitched for increased strength. Padding 20 requires no straps or hook and loop fasteners for wearing or tightening by the user, and is thus, relatively easier to put on, especially for children. Once properly positioned, padding 20 will not slide up or down the wearer's arm during use. Though only a right hand padding 20 is illustrated, it should be recognized that a corresponding left hand padding, being nearly identical in structure to padding 20 is also within the scope of and taught by the present invention. Preferably, during an exhibition, tournament, match, practice, the wearer would wear both left and right forearm/hand paddings to provide maximum protection to the wearer and his or her opponent, if any. Furthermore, by having the forearm padding and hand padding as a continuous one piece combined unit, a greater area of protection is provided to the wearer's forearm and hand areas.

Figure 3:
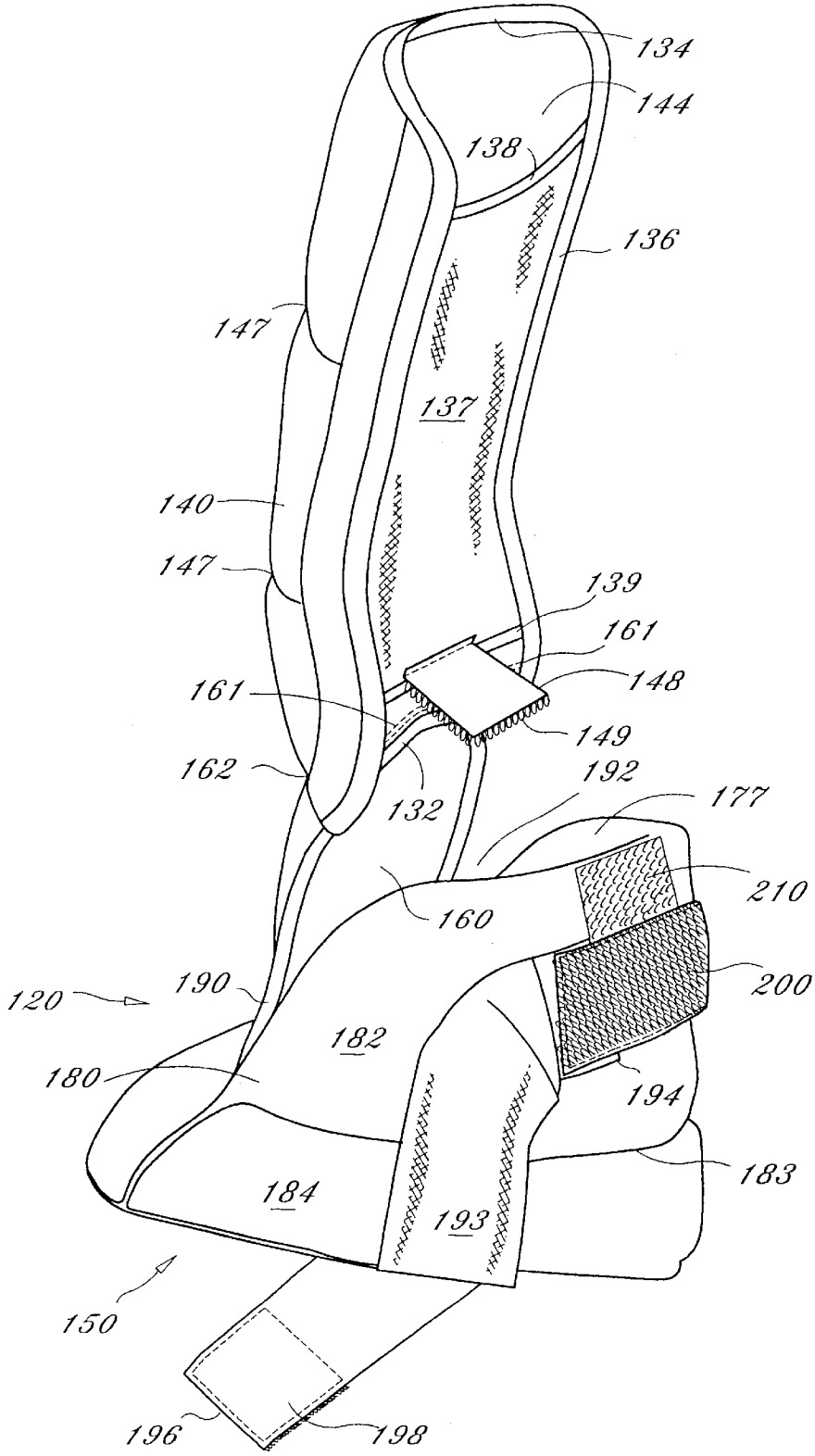
FIG. 3 is perspective view of the protective one-piece foot and shin padding in accordance with the present invention.
Figure 4:
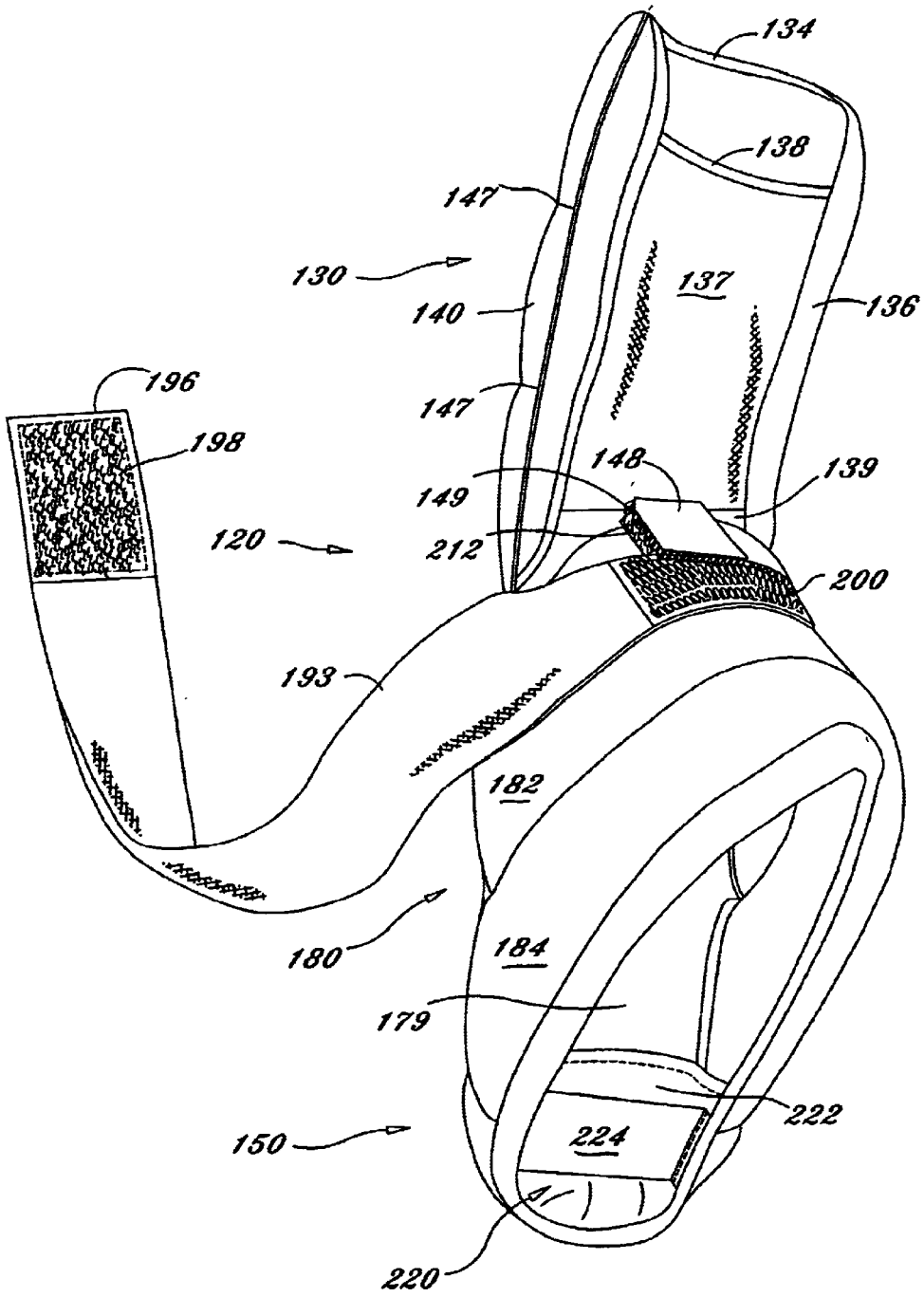
FIG. 4 is a bottom perspective view of the protective one-piece foot and shin padding of FIG. 3.

FIGS. 3 and 4 illustrate a protective one-piece foot and shin padding, in accordance with the present invention, which is generally designated padding 120. Padding 120 generally includes a shin protective member 130 and a foot/ankle protective member 150 which are attached to each other, preferably by double stitching (such as at reference numeral 161), at first end 132 of member 130 and first end 162 of a upper/tongue section 160 of member 150. Though double stitching attachment is preferred, other conventional stitching and attachment arrangements can be used, and are considered within the scope of the invention. Additionally, in lieu of attaching member 130 and member 150 together, members 130 and 150 can be integrally constructed. Members 130 and 150 can be attached in a non-overlapping relationship.

An upper portion 140 of member 130 consist of an outer material, similar to material 42, which can be constructed from polyurethane, polyvinylchloride, leather, or other similar conventional materials and an inner material, similar to material 43, which can be constructed from any type of conventional absorbent foam material, or other similar conventional materials. Inner and outer materials extend from first end 132 to a second end 134 of member 130. Additionally, the inner material can be one continuous piece, or alternatively, a plurality of pieces, divided and retained by stitching 147. A lining, similar to lining 45, preferably waterproof and/or washable, such as a TAFETA lining, can be as provided, and serves as the inner surface of upper portion 140 which abuts at least a substantial portion of the wearer's shin.

A lower portion 136 of member 130 consists of an elastic member 137 having less flexible ends 138 and 139. Elastic member 137 and ends 138 and 139 are attached to the sides of upper portion 140 by conventional means, such as stitching. A first tab member 148, having a hook and loop fastener element 149 disposed on a first surface, is attached to end 139, by conventional means, such as stitching, and depends downward therefrom.

Lower portion 136 and upper portion 140 define an opening/receiving area 144 for insertion of the wearer's foot and ankle, and disposal of a substantial portion of the wearer's shin when padding 120 is properly positioned. When at least a portion of the wearer's shin is properly positioned within member 130, elastic member 137 securely, yet comfortably, wraps around the bottom portion of the wearer's leg, to firmly retain member 130 in place.

Foot/ankle member 150 consists of an upper/tongue portion 160, side portion 180 and toe receiving section 220. Upper/tongue portion 160 consist of an outer material, similar to material 42, which can be constructed from polyurethane, polyvinylchloride, leather, or other similar conventional materials and an inner material, similar to material 43, sandwiched between the outer material, which can be constructed from any type of conventional absorbent foam material, or other similar conventional materials.

Side portion 180 includes an ankle support area 182 and a foot area 184. The shape of side portion 180 is similar to a conventional "high top" sneaker. Both ankle area 182 and foot area 184 can include an outer material similar to the outer material of upper/tongue portion 160, sandwiching an inner padding material, which is similar to the inner material of upper/tongue portion 160. The single piece inner padding material can be provided which provide protection to both ankle area 182 and foot area 184. Alternatively, two separate pieces of inner padding material can be provided, one for ankle area 182 and one for foot area 184. The separate pieces can be retained and divided by stitching 183.

Slits 190 and 192 are defined between upper/tongue portion 160 and ankle area 182, to allow the adjacent section of portion 160 to be flexible, which allows foot member 150 to be put on easier by the wearer. Furthermore, upper/tongue portion 160 and ankle area 182 define an opening 177 at the top of member 150. Upper/tongue portion 160 and ankle area 182 also define, in conjunction with foot area 184, a foot and ankle receiving area 179. The bottom of foot area 184 defines an opening 185.

A first end 194 of a strap 193 is attached to the back outer surface of ankle area 182 by conventional means, such as stitching. A second end 196 of strap 193 is provided with a hook and loop fastener element 198 on the same side of strap 193 which abuts the outer surface of ankle area 182 at first end 194. A hook and loop fastener element 200 is also at the back outer surface of ankle area 182 by conventional means, such as stitching, and can be attached such that a portion of element 200 overlaps a substantial portion of attached first end 194 of strap 193.

Once the wearer's foot is properly disposed within member 150, strap 194 is tightly wrapped horizontally around ankle area 182 and the adjacent section of upper/tongue portion 160 and fastener element 198 is allowed to mate with fastener element 200 to properly maintain member 150 and also provide additional support and protection to the wearer's ankle.

A second tab member 210 is also attached to the back outer surface of ankle area 182 by conventional means, such as stitching, and is provided with hook and loop fastening element 212. Fastening element 212 mates with fastening element 149 of tab member 148, to adjoin the shin protection member 130 and foot/ankle protection member 150 together for ease in manufacturing and also insuring against rips in any stress areas of padding 120.

Toe receiving section 220 preferably, consist of a non-elastic yet flexible member 222 which is attached to an inner lower front section of foot area 184 by conventional means, such as stitching and an elastic member 224 which is also attached to the inner front section of foot area approximate to the attachment point of member 222. Member 222 can be constructed from the same material as the outer material of upper/tongue portion 160. When in use, the wearer's toes, and possibly a small portion of the wearer's feet, are disposed between members 222 and 224, such that, member 224 securely abuts the bottom portion of the wearer's foot. Toe receiving section 220 allows for added support.

Preferably all seams of protective one-piece shin and foot/ankle padding 120 are double stitched for increased strength. Shin member 130 requires no straps or hook and loop fasteners for wearing or tightening by the user, and is thus, relatively easier to put on, especially for children. Once properly positioned, padding 120 will not slide up or down the wearer's leg during use. Though only a right leg padding 120 is illustrated, it should be recognized that a corresponding left shin/foot padding, being nearly identical in structure to padding 120 is also within the scope of and taught by the present invention. Preferably, during an exhibition, tournament, match, practice, the wearer would wear both left and right shin/foot paddings to provide maximum protection to the wearer and his or her opponent, if any. Most likely, the user will wear both left and right forearm/hand pads and left and right shin/leg pads during the exhibition, tournament, etc. All arrangements are considered within the scope of the invention.

Furthermore, by having the shin padding and foot/ankle padding as a continuous one piece combined unit, a greater area of protection is provided to the wearer's shin, foot and ankle areas.

Additionally, elastic member are preferably provided for retaining the paddings, it should be understood that other conventional resilient devices and materials can be utilized and are considered within the scope of the invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination one-piece foot and shin protective device for protecting a wearer's foot and at least a portion of the wearer's shin, comprising:

a foot padding member having a tongue portion and a side portion, said tongue portion and said side portion defining a first slit disposed on a first side of said foot padding member and a second slit disposed on a second side of said foot padding member;

a shin padding member attached to said foot padding member;

means for retaining said foot padding member on the wearer's foot; and means for retaining said shin padding member on at least a portion of the wearer's shin.

2. The combination one-piece foot and shin protective device of claim 1 wherein said means for retaining said foot padding member comprising:

a strap member attached at one end to said foot padding member; and means for attaching a second end of said strap member to said foot padding member.

3. The combination one-piece foot and shin protective device of claim 2 wherein said means for attaching is a first hook and loop fastening element disposed at a first surface of the second end of said strap member and a second hook and loop fastening element attached to the outer surface of said foot padding member.

4. The combination one-piece foot and shin protective device of claim 3 wherein first and second hook and loop fastening elements mate with each other when said strap member is tightly disposed around said padding member.

5. The combination one-piece foot and shin protective device of claim 1 wherein said foot padding member has a toe receiving section.

6. The combination one-piece foot and shin protective device of claim 1 wherein said foot padding member having a substantially open bottom.

7. The combination one-piece foot and shin protective device of claim 1 wherein said foot padding member is permanently attached to said shin padding member.

8. The combination one-piece foot and shin protective device of claim 1 wherein said foot padding member and said shin padding member are integrally constructed.

9. The combination one-piece foot and shin protective device of claim 1 wherein said means for retaining said shin padding member is an elastic member attached to said shin padding member, said shin padding member and said elastic member defining a continuous shin receiving area extending a substantial length of said shin padding member.

* * * * *